US006161265A

United States Patent [19]

Gallucci et al.

[11] Patent Number: 6,161,265

[45] Date of Patent: Dec. 19, 2000

[54] BUCKLE ASSEMBLY

[75] Inventors: Frank Joesph Gallucci; Joseph Paul Pullano, both of Calgary, Canada

[73] Assignee: Amici Enterprises Inc., Calgary, Canada

[21] Appl. No.: 09/192,305

[22] Filed: Nov. 17, 1998

[51] Int. Cl.[7] ..... A44B 11/25

[52] U.S. Cl. ..... 24/614; 24/627

[58] Field of Search ..... 24/614, 615, 618, 24/625, 627

[56] References Cited

U.S. PATENT DOCUMENTS

| | | |
|---|---|---|
| 658,124 | 9/1900 | Semple . |
| 736,576 | 8/1903 | Camp . |
| 1,020,840 | 3/1912 | Norwood . |
| 1,666,033 | 4/1928 | Nittel . |
| 1,666,864 | 4/1928 | Nittel . |
| 1,775,174 | 9/1930 | Roy . |
| 1,778,029 | 10/1930 | Johnson . |
| 1,804,370 | 5/1931 | Johnson . |
| 1,821,839 | 9/1931 | Kerngood . |
| 1,853,884 | 4/1932 | Russell . |
| 2,219,674 | 10/1940 | Zola . |
| 2,397,284 | 3/1946 | Miller . |
| 2,811,766 | 11/1957 | Tempelhof . |
| 2,896,696 | 7/1959 | Molla et al. . |
| 3,162,919 | 12/1964 | Shee . |
| 3,548,909 | 12/1970 | Sander . |
| 4,501,027 | 2/1985 | Olsson . |
| 4,610,056 | 9/1986 | Emmert . |
| 4,864,700 | 9/1989 | Kasai ..... 24/625 X |
| 4,932,104 | 6/1990 | Kowal . |
| 6,023,820 | 2/2000 | Fair . |

FOREIGN PATENT DOCUMENTS

| | | |
|---|---|---|
| 1 273 238 | 7/1968 | Germany . |

*Primary Examiner*—James R. Brittain

[57] ABSTRACT

A buckle assembly adaptable for use with strap portions, and comprising a hooking member and a receiving member is provided. The hooking member and receiving member of the present invention lockingly engage in a tensioned position to provide a secure connection. In an engaged and tensioned position, an interference portion on the hooking member securely retains the hooking member within a slot on the receiving member and prevents premature disengagement of the buckle assembly.

12 Claims, 2 Drawing Sheets

BUCKLE ASSEMBLY

FIELD OF THE INVENTION

The present invention relates to a buckle assembly for use in securing straps to each other.

BACKGROUND OF THE INVENTION

In warehouses, manufacturing plants and retail outlets, it is often desirable to simultaneously transport a stack of items, such as cartons, boxes or bags. To facilitate the transport of numerous items, boxes, for example, are routinely stacked on a pallet and transported to a desired location by a fork-lift or pallet jack. The pallet load may be subsequently loaded onto a suitable vehicle such as a truck, trailer or railcar for more extended transport. In an effort to ensure the stability of such items on a pallet, during both intermediary and extended transport, a wrapping of some sort is routinely placed around the load. Contained within a secure wrapping, the load is more likely to remain positioned on the pallet as it is transported to a desired location.

Conventionally, wrapping was of a saran-type nature which was disposed after a single use. With the advent of the environmental age, reusable pallet wrappers have become increasingly popular and are rapidly serving to replace the saran-type disposable wrappers. U.S. Pat. No. 5,226,544 discloses a reusable pallet wrapper for securing loads of variable sizes on a pallet for transportation thereabout. The pallet wrapper of this invention is installed about a cluster of items with a series of straps and buckles such that the tension of the wrapper is evenly distributed across the width of the pallet. The straps and buckles are attached to reinforcing rods at two opposing ends of the pallet wrapper, and serve to reduce the problem of pressure points on the wrapped items and bulging of the wrapper material.

Pallet wrappers such as that disclosed in U.S. Pat. No. 5,226,544 employ standard strap and buckle connections or Velcro (trade mark) reinforcements to secure the wrapper around the pallet load. Velcro (trade mark) type connections have a tendency to loosen during transport and are devoid of a locking feature. Standard strap and buckle-type connections are tedious and time-consuming to employ, and often become disengaged during pallet wrapping and rough transport. In addition, existing strap and buckle-type connections are often damaged during the course of routine handling. In most commercial and industrial type settings, such as warehouses, manufacturing plants and retail outlets, time management is of critical importance and accordingly, fast, simple and secure pallet wrapping procedures are preferred.

In the wake of the transition from disposable, saran-type pallet wrappers to the more environmentally conscious, reusable-type, efforts have focused on improving the effectiveness, utility and durability of such reusable pallet wrappers.

It is an object of the present invention to provide a lockingly engageable buckle assembly.

It is a further object of the present invention to provide a buckle assembly which can be quickly engaged in a locked connection and subsequently released therefrom.

An object of a preferred form of the present invention is to provide a buckle assembly which can be employed with a pallet wrapper to provide a secure engagement under conditions of rough handling and transport.

SUMMARY OF THE INVENTION

The present invention provides a buckle assembly adaptable for use with strap portions and capable of lockingly engaging in a tensioned position about an item or items to be secured. The buckle assembly of the present invention is particularly useful in that it provides features to ensure the connection of the buckle assembly during transport and rough handling.

In accordance with one aspect of the present invention a buckle assembly comprising a hooking member attachable to a first strap portion, said hooking portion comprising a body portion having an angled lip and an interference member projecting outwardly therefrom; and a receiving member attachable to a second strap portion, said receiving member including a receiving slot for receiving said angled lip of said hooking member; wherein said interference member lockingly engages said angled lip of said hooking member within the receiving slot of said receiving member.

In accordance with another aspect of the present invention there is provided a buckle assembly comprising a hooking member attachable to a first strap portion, said hooking member comprising of a body portion having an angled lip and an interference member outwardly projecting therefrom; and a receiving member attachable to a second strap portion, said receiving member including a pair of side walls connected at one end by an outer end portion and at an opposite end by a tongue portion; said receiving member further including a bridge member and a support member positioned between said outer end portion and said tongue portion to provide a receiving slot and a pair of parallel openings; wherein said second strap portion is adaptable for connection with said receiving member through said pair of parallel openings and wherein when said hooking member communicates with said receiving slot of said receiving member and said second strap portion is tensioned about said receiving member, said angled lip engages said outer end portion of said receiving member and said interference member contacts said bridge member to provide a locking engagement between said hooking member and said receiving member; said receiving member further including a gripping edge which communicates across said second strap portion to maintain the tensioned position of said second strap portion when said receiving member and said hooking member are in said locking engagement.

DETAILED DESCRIPTION OF PREFERRED EMBODIMENTS

The utility of a pallet wrapper resides in its ability to secure a plurality of items about a pallet for the purpose of safe and efficient loading and short and long haul transportation, by fork-lift, pallet jack, truck, trailer or railcar, to name but a few. In the case of pallet wrappers of the reusable-type, the securing function is routinely achieved by Velcro (trade mark) straps or other such strap and buckle arrangements.

The present invention discloses a buckle assembly 40 which provides a durable and easy-to-use securing means suitable for a variety of purposes. For example, the buckle assembly 40 of the present invention provides a secure and durable means for maintaining a wrapper or covering about a stack of items. Buckle assembly 40 is adaptable for use with a pallet wrapper and provides an easy-to-use and efficient method of securing a wrapper or covering about items on a pallet during occasions of rough handling, which, for example, routinely occur as items are transport between manufacturing plants, warehouses and retail outlets. Although the following description will describe buckle assembly 40 as it functions in securing a wrapper or covering about items on a pallet, the use of buckle assembly 40 in securing any item in a buckled fashion is not devoid from the teachings of the present invention.

Figure 1:
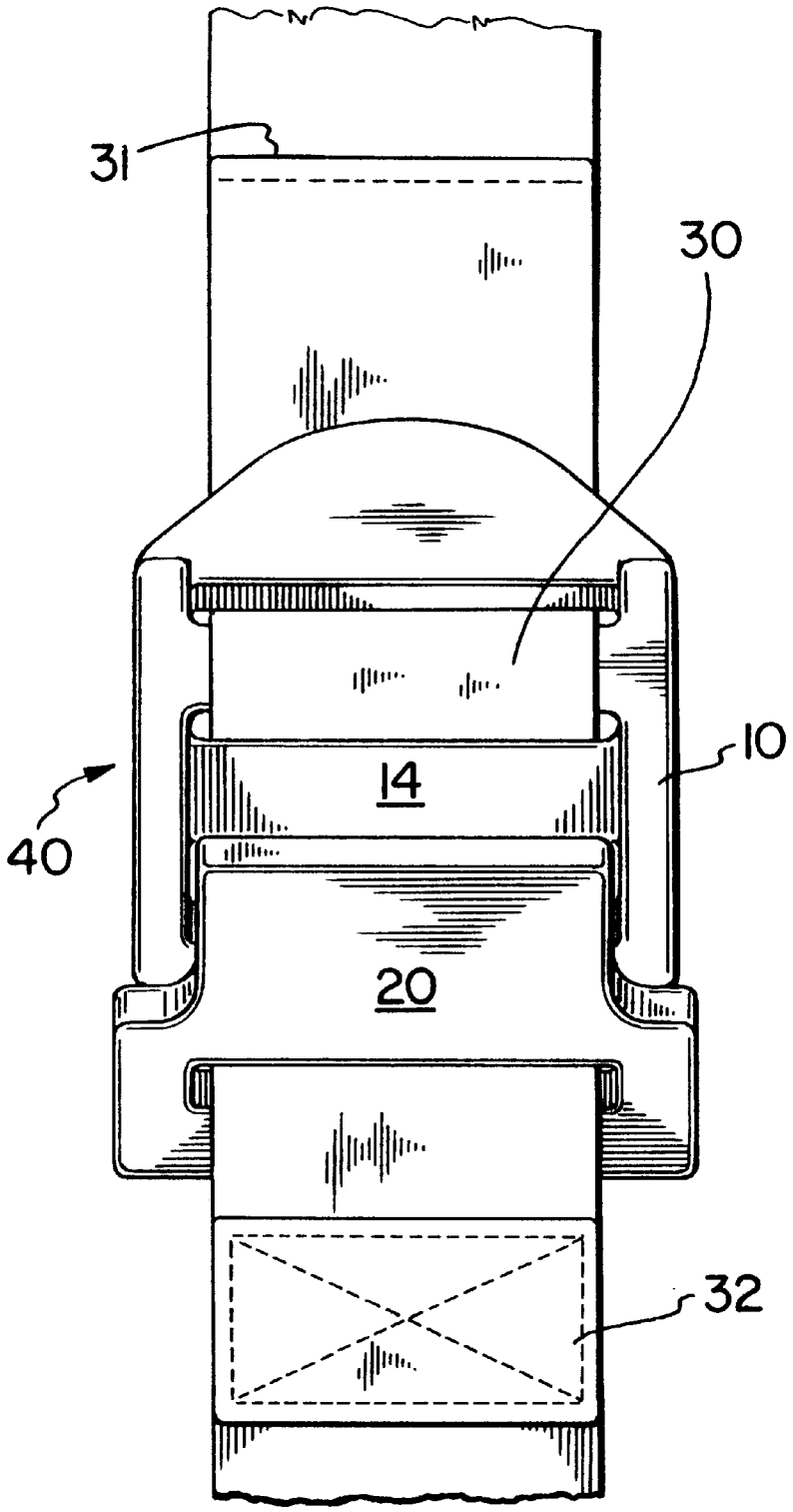
FIG 1 is a top view of the buckle assembly of the present invention.
Figure 2A:
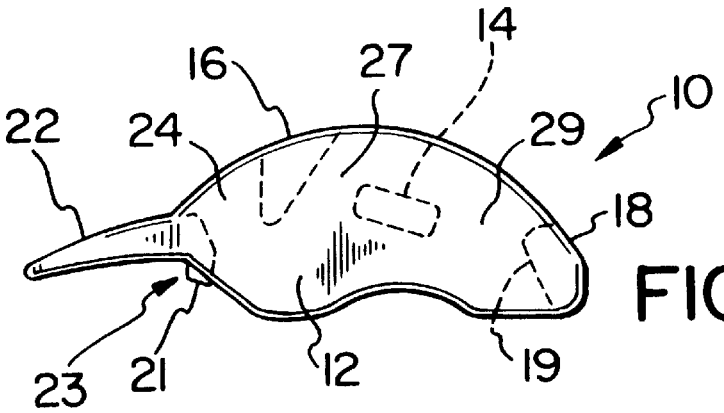
FIG. 2A is a side view of the receiving portion of the present invention.
Figure 2B:
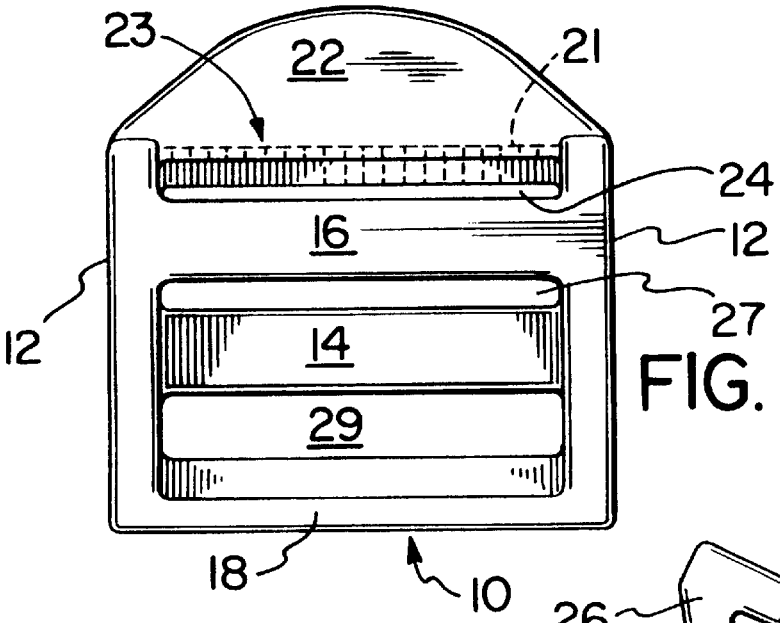
FIG. 2B is a top view of the receiving portion of the present invention.
Figure 3A:
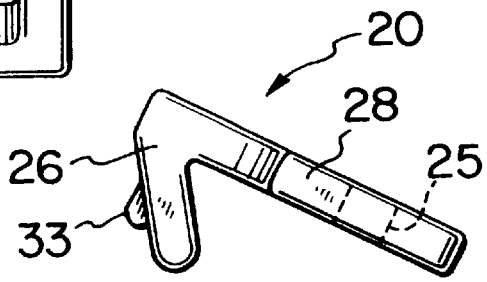
FIG. 3A is a side view of the hooking portion of the present invention.
Figure 3B:
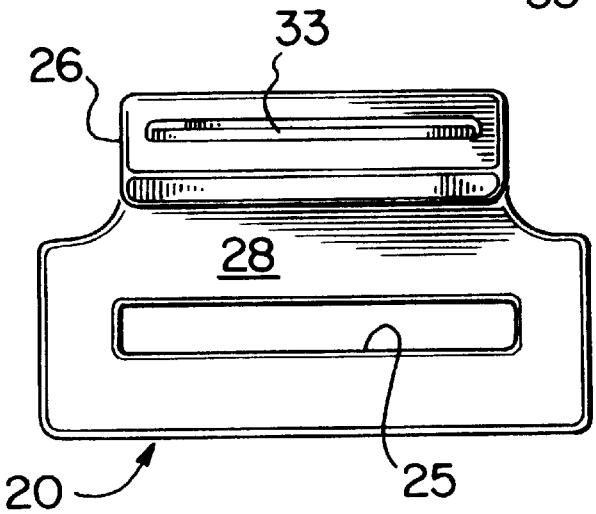
FIG. 3B is a bottom view of the hooking portion of the present invention.

As illustrated in FIG. 1, in an engaged position, the buckle assembly 40 of the present invention includes a receiving member 10 and a hooking member 20 in respective connection with straps 30 and 32. In the case where buckle assembly 40 is employed as a securing means for a reusable pallet wrapper, straps 30 and 32 may be attached to opposite ends of the wrapper. As illustrated in FIG. 1, strap 30 is in adjustable connection with receiving member 10, while strap 32 is fastened to hooking member 20. Alternatively, a single strap may be adjustably received at a first end by receiving member 10 and securely fastened at an opposite end to hooking member 20.

FIGS. 2A and 2B, and FIGS. 3A and 3B illustrate different views of receiving member 10 and hooking member 20, respectively. Receiving member 10 generally comprises of opposing side walls 12 displaced by a bridging support member 14 and an angular guiding portion 16, a front outer edge 18 and a tongue portion 22. Hooking member 20 is generally J-shaped and includes a slot 25 proximate a first end of a base portion 28 and an angled hook portion 26 at a second end. Hook portion 26 extends downwardly from base portion 28 and includes an interference lip 33 along its outer surface.

The positioning of angular guiding portion 16 and bridging support member 14 between opposing side walls 12 and tongue portion 22 and front outer edge 18 provides openings or slots 24, 27 and 29 within receiving member 10. In an engaged position, slot 29 receives hook portion 26. Slots 24 and 27 of receiving member 10, and slot 25 of hooking member 20 serve as means for receiving straps 30 and 32, respectively. As illustrated in FIG. 1, strap 32 extends through slot 25, folds back onto itself and is stitched thereto to provide a secure attachment to hooking member 20. Alternatively, strap 30 enters slot 27 from the underside of receiving member 10, extends upward and over angular guiding portion 16 and subsequently downward into slot 24. In this arrangement, the leading end 31 of strap 30 is folded back onto itself under tongue portion 22 and accordingly, strap 30 is adjustably connected to receiving member 10. It is fully contemplated, by way of the present invention, that the receiving member 10 and hooking member 20 may communicate with one or more strap portions in a plurality of arrangements and are not limited to those herein described.

A gripping portion 23 extends along the underside of tongue portion 22. In an engaged position, buckle assembly 40 is tensioned by pulling on the leading end 31 of strap 30. The slack of straps 30 and 32 is removed by tensioning buckle assembly 40 and gripping portion 23 secures the tensioned position of strap 30. In this position, buckle assembly 40 can secure a pallet wrapper or covering around items to be contained thereon during occasions of rough handling and transport. Gripping portion 23 is comprised of a plurality of teeth 21 which individually grip strap 30 in a tensioned position. Accordingly, when buckle assembly 40 is in a tensioned position, teeth 21 grip strap 30 and prevent movement thereof through slots 24 and 27.

Angular guiding portion 16 extends upwardly between side walls 12 and creates slots 24 and 27 between tongue 22 and support bridge 14. The surfaces of angular guiding portion 16 facilitate the passage of strap 30 between slots 24 and 27. The underside of guiding portion 16 guides strap 30 upward and through slot 27. The upper surface of guiding portion 16 curves with the upper edges of side walls 12 and guides strap 30 rearwardly, while the rearward-most surface of guiding portion 16 guides strap 30 downward, through slot 24 and into contact with gripping portion 23.

Angular guiding portion 16 bears the tension of strap 30 when buckle assembly 40 is engaged to secure a pallet wrapper or covering. Alternatively, in a disengaged position, strap 30 is not tensioned about receiving member 10 and can easily pass through slots 24 and 27. However, in this disengaged position, angular guiding portion 16 and gripping portion 23 prevent receiving member 10 from sliding off of strap 30. Accordingly, receiving member 10 is constructed to prevent accidental detachment and loss when buckle assembly 40 is maintained in a disengaged position.

Hooking member 20 engages with receiving member 10 at slot 29. Slot 29 is provided between bridging support member 14 and front outer edge 18. The interior surface 19 of front outer edge 18 is angled so as to be compatible with the angle of hook portion 26 of hooking member 20. As hook portion 26 is placed in slot 29, interference lip 33 catches bridging support member 14 of receiving member 10 and obstructs entry of hooking member 20 into slot 29. Pressure on body portion 28, proximate the hook portion 26, causes an adjustment in the angle of hooking member 20 with respect to slot 29, thus allowing interference lip 33 to snap past bridging support member 14. In this position, hook portion 26 engages front outer edge 18 via slot 29, while interference lip 33 catches the edge of bridging support member 14 and retains hooking member 20 in an engaged arrangement with receiving member 10.

Subsequently, hook portion 26 can be snapped from its engaged position within slot 29 under downward pressure on the base portion 28 proximate the first end. Again, the angle of hook portion 26 is adjusted within slot 29, allowing interference lip 33 to snap past the edge of bridging support member 14. However, when buckle assembly 40 is in an engaged and tensioned position about a pallet wrapper, downward pressure on the body portion 28 is prevented by the cargo or items contained within the pallet wrapper or covering, thus, further ensuring the security of the engagement.

Upon transporting items to a desired location, the buckle assembly 40 of the present invention can be easily disengaged by lifting tongue portion 22. This causes receiving member 10 to pivot about an end opposite tongue portion 22 so as to raise gripping portion 23 from contact with the surface of strap 30. Accordingly, strap 30 is loosened and the tension of buckle assembly 40 is released. In the absence of tension, downward pressure can be applied to the first end of base portion 28 of hooking member 20, thus releasing hook portion 26 from slot 29.

Pallet wrappers are frequently employed in a variety of warehouses, manufacturing plants and retail outlets, where time constraints require large quantities of items to be loaded, transported and subsequently unloaded in relatively short periods of time. Accordingly, a buckle assembly which is efficient, durable and effective is preferred. Buckle assembly 40 of the present invention can be injection molded from a variety of plastic resins to provide a light-weight and durable buckle. Accordingly, buckle assembly 40 is constructed such that it can be quickly snapped into engagement with a single motion. Similarly, buckle assembly 40 can also be efficiently disengaged. Buckle assembly 40 of the present invention provides the added feature of having interference lip 33 which prevents the disengagement of hooking member 20 from receiving member 10 during rough transportation conditions. Further, the use of injection molded plastic resins in the manufacture of receiving member 10 and hooking member 20 provides a light-weight and durable connection capable of withstanding frequent use and rugged handling. Further still, the light-weight composition of receiving member 10 facilitates its connection with strap 30 when buckle assembly 40 is in a disengaged position. However, the present invention is not herein limited to a plastic resin composition. For example, in some cases, a metal buckle assembly of the present invention may be preferred.

What is claimed is:

1. A buckle assembly comprising:

a hooking member and a receiving member attachable to a first and second strap portion, respectively, said hooking member including a planar angled lip extending from a body portion; said receiving member having a receiving slot adaptable for receiving said angled lip of said hooking member; said receiving slot being defined between a pair of side walls of said receiving member: connected at one end by an outer end portion and at another location by a bridge member; wherein said angled lip includes an interference member projecting outwardly therefrom such that when said angled lip is received by said receiving slot, said angled lip fittingly engages said outer end portion of said receiving member and said interference member contacts said bridge member to provide a secure engagement therebetween.

2. The buckle assembly of claim 1 wherein when said hooking member and said receiving member are attached to a first and second strap portion, respectively, at least one of said first and second strap portions is attached in an adjustable connection and provides a means for tensioning said secure engagement.

3. The buckle assembly of claim 2 wherein said receiving member further includes a tongue portion extending from said receiving member at an end opposite said outer end portion; and a support member; wherein said support member displaces said pair of side walls at a location between said bridge member and said tongue portion so as to provide a pair of parallel openings on adjacent sides thereof.

4. The buckle assembly of claim 3 wherein said pair of parallel openings provide a first and a second slot for receiving said second strap portion in an adjustable connection with said receiving member.

5. The buckle assembly of claim 4 wherein said receiving member further includes a gripping edge for gripping said second strap portion.

6. The buckle assembly of claim 5 wherein said second strap portion extends through said first and second slots, and over said support member such that said second strap portion is positioned to be engaged by said gripping edge.

7. The buckle assembly of claim 6, wherein said gripping edge maintains said second strap portion in a tensioned position about said support member.

8. The buckle assembly of claim 7 wherein said receiving member further provides a releasing means for releasing the tension of said second strap portion about said support member.

9. The buckle assembly of claim 8 wherein said releasing means is enabled by pivoting said receiving about said outer end portion and disengaging said gripping edge from said second strap portion.

10. A buckle assembly comprising:

a hooking member attachable to a first strap portion, said hooking member comprising a body portion having a planar angled lip and an interference member outwardly projecting therefrom; and a receiving member attachable to a second strap portion, said receiving member including a pair of side walls connected at one end by an outer end portion and at an opposite end by a tongue portion; said receiving member further including a bridge member and a support member positioned between said outer end portion and said tongue portion to provide a receiving slot and a pair of parallel openings; wherein said second strap portion is adaptable for connection with said receiving member through said pair of parallel openings and wherein when said hooking member communicates with said receiving slot of said receiving member and said second strap portion is tensioned about said receiving member, said angled lip engages said outer end portion of said receiving member and said interference member contacts said bridge member to provide a secure engagement between said hooking member and said receiving member; said receiving member further including a gripping edge which communicates across said second strap portion to maintain the tensioned position of said second strap portion when said receiving member and said hooking member are in said secure engagement.

11. A buckle assembly comprising:

a hooking member and a receiving member each adaptable to receive a first and second strap portion, respectively; said hooking member including a planar angled lip extending from a body portion;

said body portion including at least one opening for receiving said first strap portion; said receiving member including a pair of side walls connected at one end by an outer end portion and at an opposite end by a tongue portion; said receiving member further including a bridge member and a support member positioned between said outer end portion and said tongue portion; and defining a receiving slot and a pair of parallel openings; said parallel openings being adaptable to receive said second strap portion in adjustable connection; said angled lip including an interference member projecting outwardly therefrom such that when said angled lip is received by said receiving slot, said angled lip fittingly engages said outer end portion of said receiving member and said interference member contacts said bridge member to provide a secure engagement therebetween; wherein when said second strap portion is provided in adjustable connection with said parallel openings a means for tensioning said secure engagement is provided.

12. The buckle assembly of claim 11 wherein said receiving member further includes a gripping edge which communicates with said second strap portion to maintain said buckle assembly in a tensioned position when said receiving member and said hooking member are in said secure engagement.

* * * * *